US005983687A

United States Patent [19]

Shen

[11] Patent Number: 5,983,687

[45] Date of Patent: Nov. 16, 1999

[54] POSITIONING DEVICE FOR A CYLINDRICAL LOCK

[76] Inventor: Mu-Lin Shen, No. 32, Lane 76, Sec.5, Fuan Rd., Tainan, Taiwan

[21] Appl. No.: 08/999,112

[22] Filed: Dec. 29, 1997

[51] Int. Cl.[6] ..... E05B 55/04

[52] U.S. Cl. ..... 70/467; 292/169.22; 292/336.5; 292/358; 292/DIG. 64

[58] Field of Search ..... 292/336.5, 358, 292/359, 169.15, 169.21, 169.22, 169.23, DIG. 53, DIG. 64; 70/224, 476, 477, 478, 479, 483, 484, DIG. 31, DIG. 32

[56] References Cited

U.S. PATENT DOCUMENTS

| | | | |
|---|---|---|---|
| 1,751,101 | 3/1930 | Schlape | 292/169.22 |
| 1,829,815 | 12/1931 | Schlage | 292/169.22 |
| 3,093,400 | 6/1963 | Williams | 292/358 |
| 3,126,217 | 3/1964 | Russell et al. | 292/169.22 |
| 3,128,112 | 4/1964 | Fryer | 292/359 |
| 3,136,572 | 6/1964 | Lytle | 292/359 |
| 3,269,158 | 8/1966 | Andre | 70/477 |
| 4,428,212 | 1/1984 | Best et al. | 292/336.5 |
| 4,594,864 | 6/1986 | Hart | 292/169.15 |
| 5,651,280 | 7/1997 | Park | 70/224 |

*Primary Examiner*—Darnell M. Boucher
*Attorney, Agent, or Firm*—William E. Pelton, Esq.

[57] ABSTRACT

A positioning device for a cylindrical lock includes two first upper protrusions and two first lower protrusions respectively extending from an inside hub of the lock, two second upper protrusions and two second lower protrusions respectively extending from an outside hub. A chassis receiving a retractor therein has two first plates extending from a top surface thereof and two second plates extending from a bottom surface thereof. The two first plates of the chassis are received between the two first upper protrusions and two second upper protrusions, and the two second plates are received between the two first lower protrusions and two second lower protrusions such that the chassis is stationed between the inside and outside hub so as to let a pair of screws extend through these easily.

2 Claims, 3 Drawing Sheets

POSITIONING DEVICE FOR A CYLINDRICAL LOCK

BACKGROUND OF THE INVENTION

1. Field of the Invention

The present invention relates to a positioning device and, more particularly, to an improved positioning device used in a cylindrical lock so that when a retractor between an inside and an outside sleeve-hub assembly is assembled using a pair of screws, the two sleeve-hub assemblies anchor the retractor so as to facilitate an assembler to manipulate the screws.

2. Brief Description of the Prior Art

FIG. 1 shows a commonly used positioning device for a cylindrical lock, wherein a retractor 100 is received in a C-shaped chassis 11 and an inside sleeve-hub assembly 20 includes an inside hub 21 into which an inside sleeve 22 is partially inserted, a tail piece 23 and an inside turn button 24 respectively disposed to the inside sleeve-hub assembly 20. An outside sleeve-hub assembly 30 includes an outside hub 31 and an outside sleeve 32 partially inserted into the outside hub 31. The chassis 11 together with the retractor 100 engaged with a latch bolt (not shown) connected between the inside sleeve-hub assembly 20 and the outside sleeve-hub assembly 30 by a pair of screws 40, and all of these will be disposed in a door (not shown). An inside escutcheon assembly with an inside handle and an outside escutcheon assembly with an outside handle are then respectively disposed to the door, as known in the art. The inside hub 21 and the outside hub 31 respectively have a flange 210/310 extending radially and outwardly therefrom, each of the flanges 210, 310 having two holes 211/311 defined diametrically opposite to each other therethrough. Two ribs 110 extend from each of an upper side and a lower side of the chassis 11, each of the ribs 110 having an aperture 111 defined therethrough so that each one of the two screws 40 extends sequentially through the hole 211, the two apertures 111 and the hole 311 to engage with the outside escutcheon assembly. However, when inserting the pair of screws 40 through the inside hub 21, the chassis 11 and the outside hub 31, there is lacks of a proper positioning device to position the three members 21, 11, 31 so that an assembler has to adjust the holes 211, 311 and the apertures 111 to become in alignment with each other. This will increase assembling time of the lock.

The present invention intends to provide an improved positioning device for a cylindrical lock to mitigate and/or obviate the above-mentioned problems.

SUMMARY OF THE INVENTION

The present invention provides a positioning device for a cylindrical lock comprising a retractor received in a chassis and in engagement with a latch bolt, an inside hub and an outside hub, an inside sleeve and an outside sleeve operable to rotate with respect to the inside and said outside hub, an inside escutcheon and an outside escutcheon supporting the cylindrical lock. The positioning device comprises two first upper protrusions and two first lower protrusions respectively extending longitudinally from an end face of the inside hub, two second upper protrusions and two second lower protrusions extending from an end face of the outside hub, wherein the end face of the inside hub faces to the end face of the outside hub. Two holes are respectively defined through the inside hub and located between the two first upper protrusions and the two first lower protrusions. Two screw holes are respectively defined through the outside hub and located between the two second upper protrusions and the two second lower protrusions.

The chassis has two first plates extending upwardly from a top surface thereof and respectively received between the two first upper protrusions and the two second upper protrusions, and two second plates extending downwardly from a bottom surface thereof and respectively received between the two first lower protrusions and the two second lower protrusions. Each of the first plate and the second plate has an aperture defined therethrough. Two screws each extend through the hole, the two apertures and the screw hole.

It is an object of the present invention to provide a positioning device for a cylindrical lock and which positions the chassis between the inside hub and the outside hub so as to easily assemble them together by two screws.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
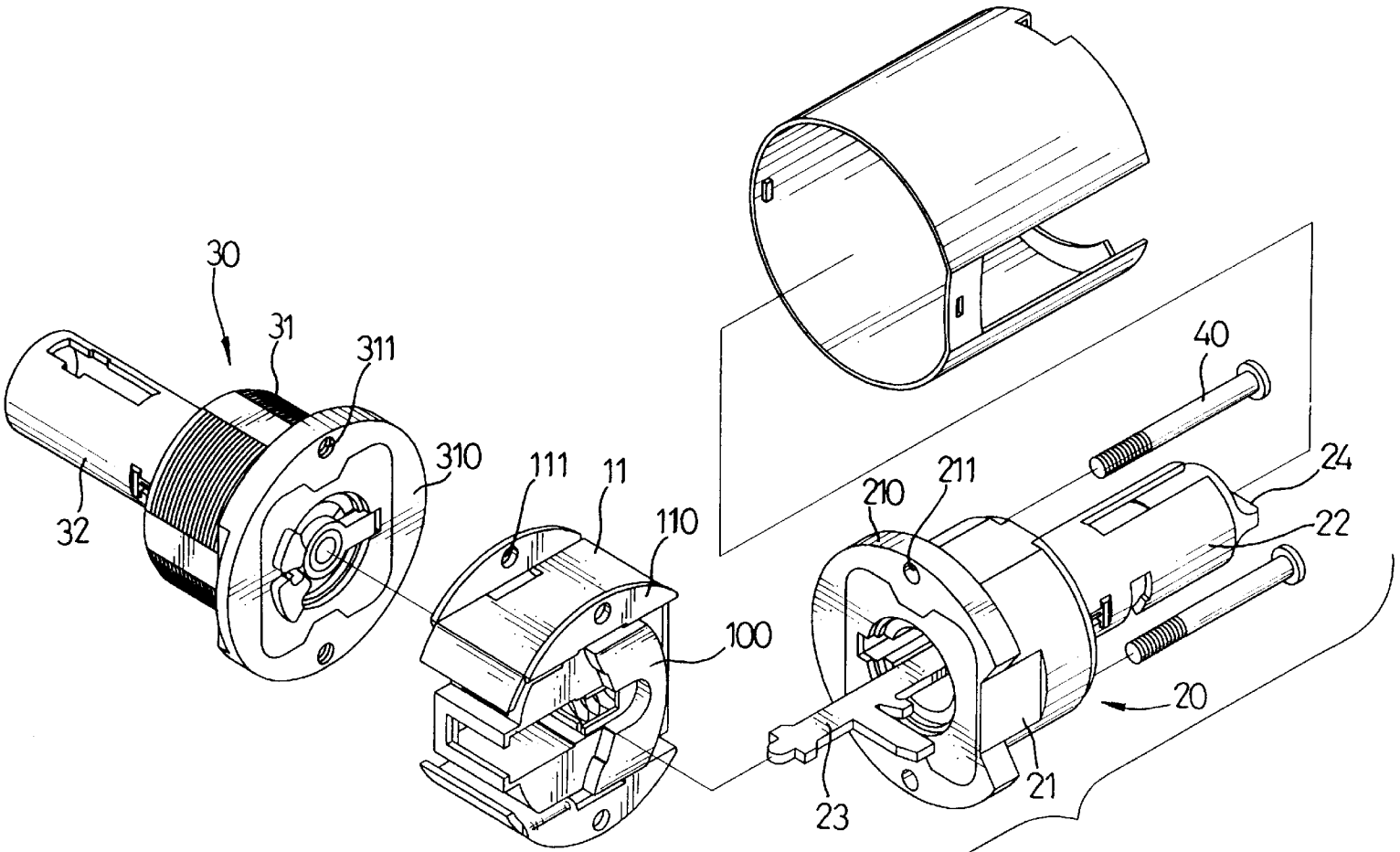
FIG. 1 PRIOR ART
FIG. 1 is an exploded view of a chassis, an inside hub and an outside hub of a conventional cylindrical lock.
Figure 2:
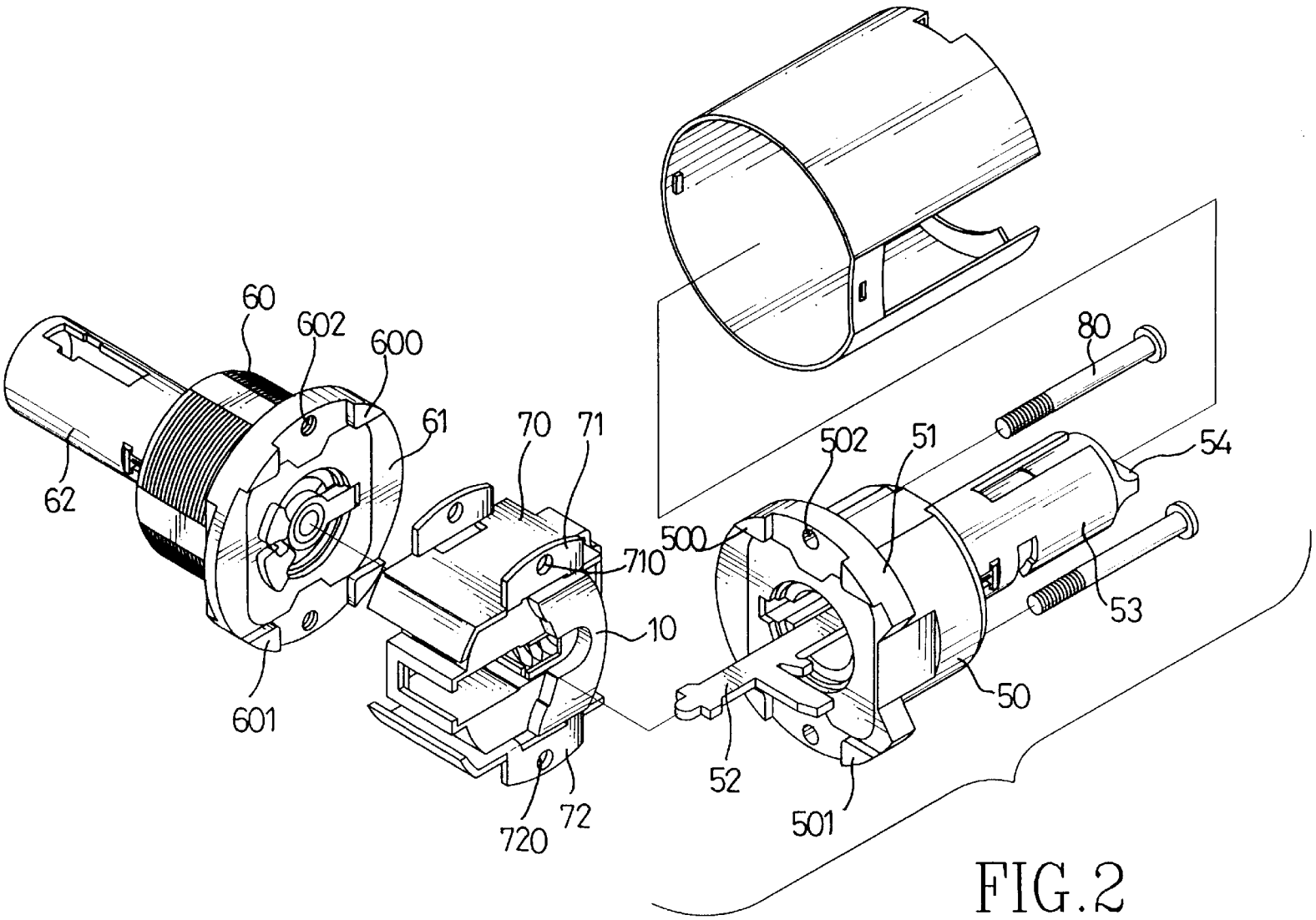
FIG. 2 is an exploded view of a chassis, an inside hub and an outside hub and shows a positioning device in accordance with he present invention.
Figure 3:
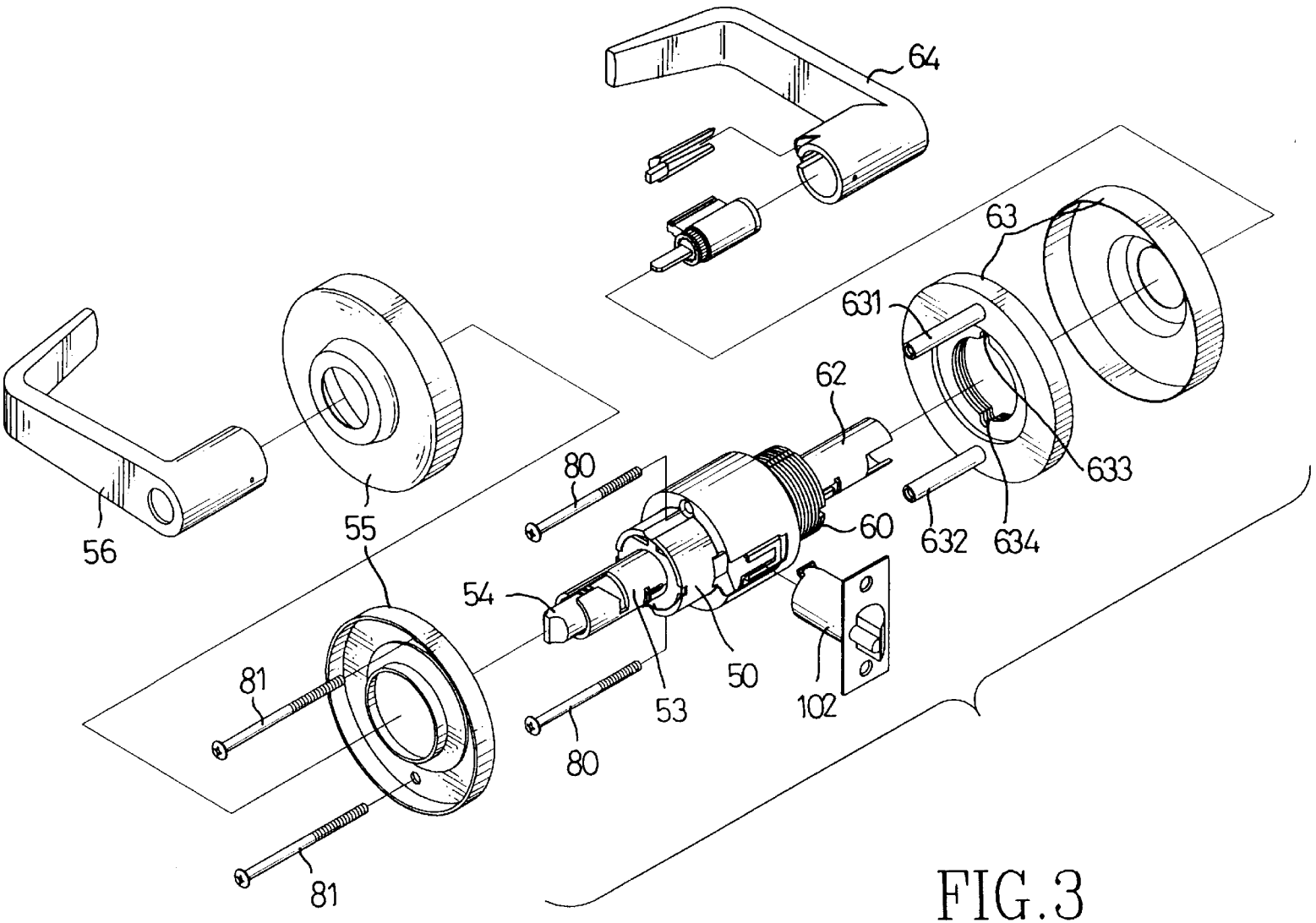
FIG. 3 is an exploded view of a cylindrical lock in accordance with the present invention.

Referring to FIGS. 2 and 3, a cylindrical lock comprises a retractor 10 received in a chassis 70 which is a C-shaped member and the retractor 10 is engaged with a latch bolt 102. An inside hub 50 has a tail piece 52 rotatably received therein and an inside sleeve 53 partially received therein so that a turn button 54 is operatably connected to the tail piece and disposed to the inside sleeve 53. An outside hub 60 has an outside sleeve 62 partially received therein. Each of the inside hub 50 and the outside hub 60 has a flange 51/61 extending outwardly and radially from an end thereof. An inside escutcheon assembly 55 and an outside escutcheon assembly 63 are respectively mounted to two sides of a door (not shown) and support the cylindrical lock. An inside handle 64 and an outside handle 56 are respectively connected to the lock and located to an inner side and an outer side of the door so that when either the inside handle 56 or the outside handle 64 is rotated, the latch bolt 102 is actuated.

A positioning device comprises two first upper protrusions 500 and two first lower protrusions 501 respectively extending longitudinally from an end face of the flange 51 of the inside hub 50. Two holes 502 are respectively defined through the flange 51 and located respectively between the two first upper protrusions 500 and the two first lower protrusions 501. Two second upper protrusions 600 and two second lower protrusions 601 respectively extend from an end face of the flange 61 of the outside hub 60. Two screw holes 602 are respectively defined through the flange 61 and located respectively between the two second upper protrusions 600 and the two second lower protrusions 601. The end face of the flange 51 of the inside hub 50 faces to the end face of the flange 61 of the outside hub 60.

The chassis 70 has two first plates 71 extending upwardly from a top surface thereof and two second plates 72 extending downwardly from a bottom surface thereof. Each of the first plates 71 and the second plate 72 has an aperture 710/720 defined therethrough. The two first plates 71 are respectively received between the two first upper protrusions 500 and the two second upper protrusions 600, and the two second plates 72 are respectively received between the two first lower protrusions 501 and the two second lower protrusions 601 such that the hole 502 in an upper portion of the flange 51, the apertures 710 in the first plates 71 and the screw hole 602 in an upper portion of the flange 61 are in alignment with each other, and the hole 502 in a lower portion of the flange 51, the apertures 720 in the second plates 71 and the screw hole 602 in the lower portion of the flange 61 are in alignment with each other.

One of two screws 80 extends through the hole 502 in the upper portion of the flange 51, the apertures 710 in the first plates 71 and the screw hole 602 in the upper portion of the flange 61 and is received in a first notch 633 defined in an upper inner periphery of the outside escutcheon assembly 63. The other of the two screws 80 extends through the hole 502 in the lower portion of the flange 51, the apertures 720 in the second plates 71 and the screw hole 602 in the lower portion of the flange 61 and is received in a second notch 634 defined in a lower inner periphery of the outside escutcheon assembly 63 so as to firmly connect the inside hub 50, the chassis 70 and the outside hub 60 together. Two long bolts 81 respectively extend through the inside escutcheon assembly 55 and threadedly engaged with two tubes 631, 632 extending from the outside escutcheon assembly 63 to dispose the lock in the door.

The positioning device of the present invention ensures that the chassis 70 is well positioned between the inside hub 50 and the outside hub 60 when assembling the cylindrical lock so that the two screws 80 can be easily extended through a combination of the three parts mentioned above so that an assembling time is effectively reduced.

Although the invention has been explained in relation to its preferred embodiment, it is to be understood that many other possible modifications and variations can be made without departing from the spirit and scope of the invention as hereinafter claimed.

What is claimed is:

1. A positioning device for a cylindrical lock comprising a retractor received in a chassis and in engagement with a latch bolt, an inside hub and an outside hub, an inside sleeve and an outside sleeve operable to rotate with respect to the inside and said outside hub, an inside escutcheon and an outside escutcheon supporting said cylindrical lock, said positioning device comprising:

two first upper protrusions and two first lower protrusions respectively extending longitudinally from an end face of said inside hub, two second upper protrusions and two second lower protrusions extending from an end face of said outside hub, wherein said end face of said inside hub faces to said end face of said outside hub, two holes respectively defined through said inside hub and located between said two first upper protrusions and said two first lower protrusions, two screw holes respectively defined through said outside hub and located between said two second upper protrusions and said two second lower protrusions;

said chassis having two first plates extending upwardly from a top surface thereof and two second plates extending downwardly from a bottom surface thereof, each of said first plate and said second plate having an aperture defined therethrough, said two first plates respectively received between said two first upper protrusions and said two second upper protrusions, said two second plates respectively received between said two first lower protrusions and said two second lower protrusions, and two screws each extending through said hole, said two apertures and said screw hole.

2. The positioning device as claimed in claim 1 wherein said inside hub and said outside hub each have a flange extending outwardly and radially from an end thereof, said first upper and said first lower protrusions extending from said flange of said inside hub, said second upper and said second lower protrusions extending from said flange of said outside hub.

* * * * *